US006203630B1

(12) United States Patent
Matsumura et al.

(10) Patent No.: US 6,203,630 B1
(45) Date of Patent: Mar. 20, 2001

(54) STEEL FOR INDUCTION QUENCHING AND MACHINERY STRUCTURAL PARTS USING THE SAME

(75) Inventors: Yasushi Matsumura; Yutaka Kurebayashi; Sadayuki Nakamura, all of Nagoya (JP)

(73) Assignee: Daido Tokushuko Kabushiki Kaisha, Aichi (JP)

( * ) Notice: Subject to any disclaimer, the term of this patent is extended or adjusted under 35 U.S.C. 154(b) by 0 days.

(21) Appl. No.: 09/616,362

(22) Filed: Jul. 13, 2000

(30) Foreign Application Priority Data

Jul. 13, 1999 (JP) ..... 11-198836

(51) Int. Cl.[7] ..... C22C 38/14; C22C 38/06; C22C 38/04

(52) U.S. Cl. ..... 148/330; 420/121; 420/126

(58) Field of Search ..... 420/121, 126, 420/106, 109, 110; 148/328, 320, 330, 906

(56) References Cited

U.S. PATENT DOCUMENTS 5,256,213 * 10/1993 Narai et al. ..... 148/906
5,298,323 * 3/1994 Narai et al. ..... 148/906
5,447,579 * 9/1995 Hirakawa et al. ..... 148/906
6,123,785 * 9/2000 Iguchi et al. ..... 148/906

FOREIGN PATENT DOCUMENTS 62-23929 1/1987 (JP) .
62-196327 8/1987 (JP) .
2-129341 5/1990 (JP) .

* cited by examiner

*Primary Examiner*—Deborah Yee
(74) *Attorney, Agent, or Firm*—Bacon & Thomas, PLLC

(57) ABSTRACT

A steel product contains, by mass %, C: 0.45 to 0.60%, Si: 0.01 to 0.15%, Mn: 0.20 to 0.60%, S: 0.012% or lower, Al: 0.015 to 0.040%, Ti: 0.005 to 0.050%, B: 0.0005 to 0.0050%, N: 0.010% or lower, O: 0.0010% or lower, and balance being Fe and unavoidable impurities. Limitations are provided to allowable maximum sizes per each sort of contained non-metallic inclusions and the number per unit area thereof. This steel may contains one kind or two kinds or more of Cr: 1.00% or lower, Mo: 0.50% or lower and Ni: 1.50 or lower.

4 Claims, No Drawings

STEEL FOR INDUCTION QUENCHING AND MACHINERY STRUCTURAL PARTS USING THE SAME

BACKGROUND OF THE INVENTION

1. Field of the Invention

The present invention relates to machinery structural parts which are formed by a cold working and are to be produced by strengthening through an induction quenching, the parts being required to have high rolling fatigue strength and torsion fatigue strength, for example, in an outer race for a joint of constant velocity, and a steel for induction quenching to be used thereto.

2. Description of the Related Art

In general, as machinery structural parts required to have the high fatigue strength such as the outer race for joints of constant velocity, medium carbon steels containing C: 0.40 to 0.60% are used. These steels are formed through a cold forging, and then increased in surface hardness by the induction quenching treatment so as to enhance the rolling fatigue strength and the torsion fatigue strength. These machinery structural parts have recently been demanded for further improving higher strengthening and cold workability because of making light weight.

Since the medium carbon steel is generally poor in the cold workability, many techniques for improving it have been developed. For example, JP-A-62-23929 and JP-A-62-196327 disclose technologies that Si and Mn in steel are limited, deoxidation and denitrification are carried out by Al and Ti, a fine amount of B is added to guarantee a high hardenability with the amount of small alloying addition, and temperature conditions of hot rolling or finish rolling temperature are controlled for improving the cold workability.

JP-A-2-129341 discloses a method for improving the cold workability of steel by limiting amounts of Si and Mn, decreasing alloying elements by adding Al, Ti and B as the above two examples, and limiting upper limits of N, S and O.

On the other hand, enhancing of strength, in particular improvement of fatigue strength mainly depend upon hardening in a skin portion by the induction quenching and compressive residual stress generated thereby, and efforts are directed to adjusting of chemical compositions in steel for efficiently demonstrating effects by the induction quenching. In parts requiring the rolling fatigue strength as outer races for joints of constant velocity, it is desirable that the hardness of the rolling face is high, but if the hardness is enhanceed, notch sensibility is increased resulting to invite a lowering of the fatigue strength, and so the enhancing of hardness is limited.

It is known that, in a hard steel, non-metallic inclusions in steel serve as sources of stress concentration and lowers the fatigue strength of steel. JP-A-2-129341 discloses a method of limiting an upper limit of O content to 0.0020%, taking prevention of deterioration of rolling fatigue life into consideration, and limiting an upper limit of Ti content to 0.05%, paying attention to prevention of forming large nitrides harmful to the rolling fatigue life.

The fatigue strength may be enhanced to a certain extent by providing methods of adjusting chemical compositions in steel as mentioned above, however, it has been difficult to decrease dispersions of the fatigue strength, in particular dispersions of the rolling fatigue life.

SUMMARY OF THE INVENTION

In view of such circumstances, it is accordingly an object of the invention to provide a steel suited to the induction quenching, having an excellent cold workability, high rolling fatigue strength and torsion fatigue strength, and less dispersions of the fatigue strength as well as machinery structural parts.

In the steel for the induction quenching, having the excellent cold workability, rolling fatigue strength and torsion fatigue strength and the machinery structural parts, mainly the contents of Si and Mn are limited for enhancing the cold workability, and B is added at a proper content for compensating the lowering of induction hardenability. For enhancing the effect of the B addition, the contents of O and N are limited, and Al and Ti of appropriate contents are added for carrying out deoxidation and denitrification. Cr, Ni and Mo may be added at small contents for compensating the hardenability of steel and increasing toughness of the same. Further, if decreasing contents of S, O and N forming non-metallic inclusions, and controlling sizes of formed non-metallic inclusions, the fatigue strength of the induction-quenched steel is improved and the dispersion thereof are lowered.

According to the present invention, the steel for high frequency induction quenching having excellent cold workability, rolling fatigue strength and torsion fatigue strength (1) contains by mass %

C: 0.45 to 0.60%,

Si: 0.01 to 0.15%,

Mn: 0.20 to 0.60%,

S: 0.012% or lower,

Al: 0.015 to 0.040%,

Ti: 0.005 to 0.050%,

B: 0.0005 to 0.0050%,

N: 0.010% or lower,

O: 0.0010% or lower, and balance being Fe and unavoidable impurities, wherein maximum sizes of contained non-metallic inclusions are, in terms of equivalent circular diameters, 15 $\mu$m or less in oxide based non-metallic inclusions, 5 $\mu$m or less in nitride based non-metallic inclusions, and 15 $\mu$m or less in sulfide based non-metallic inclusions respectively, and the numbers of the non-metallic inclusions of the equivalent circular diameters being 1 $\mu$m or more are 6 or less per 1 $mm^2$ in the oxide based inclusions, 10 or less per 1 $mm^2$ in the nitride based non-metallic inclusions, and 5 or less per 1 $mm^2$ in the sulfide based non-metallic inclusions.

(2) The steel further contains, in addition to (1), at least one of

Cr: 1.00% or lower,

Mo: 0.50% or lower, and

Ni: 1.50% or lower.

The inventive machinery structural parts have the excellent cold workability, rolling fatigue strength and torsion fatigue strength:

(3) comprises the steel for high frequency induction quenching as set forth in any one of (1) and (2).

DETAILED DESCRIPTION OF THE INVENTION

Further reference will be made to reasons for limiting the containing percentage of the chemical composition in the steel for induction quenching, having the excellent cold workability, rolling fatigue strength and torsion fatigue strength.

C: 0.45 to 0.60%

C is a necessary element for raising the quenched hardness and securing the strength of the machinery structural parts. It is therefore necessary to contain C at least 0.45%. But if excessively containing, since the cold workability and machinability are spoiled and quenching cracks might be caused when the induction quenching is performed, the upper limit of C is determined to be 0.60%.

Si: 0.01 to 0.15%

Si is added as a deoxidizing agent when melting a steel, and for exhibiting the addition effect, Si should be added at least 0.01%. But if the content is as an ordinary deoxidizing agent, it deteriorates the cold workability of steel, and for enhancing the cold workability, the upper limit is determined to be 0.15%. Preferably, Si is contained in the range of 0.05 to 0.10%.

Mn: 0.20 to 0.60%

Mn serves as a deoxidizing agent when melting a steel and enhances a hardenability of steel. For exhibiting these effects, Mn should be added at least 0.20%. But if excessively containing, since the cold workability and machinability are spoiled, the upper limit of Mn is set to be 0.60%. Preferably, Mn is contained in the range of 0.20 to 0.50%.

S: 0.012% or lower

S forms sulfide based non-metallic inclusions (JIS: A1 based inclusions) in steel and damages the cold workability and decreases the fatigue strength. So the less, the more desirable, but if it is too low, since the machinability decreases, S may be contained in the range of 0.012% or lower. Preferably, S is contained in the range of 0.010% or lower.

Al: 0.015 to 0.040%

Al is a strong deoxidizing element and prevents crystal grain of steel from coarsening. For obtaining these effects, Al of 0.015% or higher is contained. But since Al forms Al2O3 as one of oxide based non-metallic inclusions and injures the fatigue strength of steel, the upper limit of Al is set to be 0.040%. Preferably, Al is contained in the range of 0.020% to 0.035%.

Ti: 0.005 to 0.050%

Ti of 0.005% or higher is added for improving the hardenability of steel provided by B. But since Ti forms the nitride based non-metallic inclusions and spoils the fatigue strength, the upper limit is set to be 0.050%. Preferably, Ti is contained in the range of 0.020% to 0.035%.

B: 0.0005 to 0.0050%

B is added to compensate the deterioration of the hardenability by lowering the contents of Si and Mn and to secure a desired depth of hardening. It is accordingly necessary to contain 0.0005% or higher. But an excessive addition coarsens crystal grain of steel and harms a toughness, so the upper limit is set to be 0.0050%. Preferably, B is contained in the range of 0.0010 to 0.0030%.

N: 0.010% or lower

N forms nitride based non-metallic inclusions (JIS: C2 based inclusions) in steel to and injures the fatigue strength, and therefore the upper limit is 0.010%.

O: 0.0010% or lower

O forms oxide based non-metallic inclusions (JIS: C1 based inclusions) in steel and injures the fatigue strength, and the upper limit is 0.0010%.

Cr: 1.00% or lower

Cr may be added for compensating the hardenability of steel. But since an excessive content spoils the cold workability and it is difficult to make carbides in the induction quenching solid, the upper limit of Cr is set to be 1.00%. Preferably, Cr is contained in the range of 0.50% or lower.

Mo: 0.50% or lower

Mo enhances the hardenability of steel, strengthens a grain boundary and raises a toughness of martensite, and so its addition is permitted, but since an excessively content deteriorates the cold workability and machinability, the upper limit is set to be 0.50%. Preferably, Mo is contained in the range of 0.40% or lower.

Ni: 1.50% or lower

Ni enhances the hardenability of steel and raises the toughness of martensite, and so its addition is permitted, but if excessively containing, since it spoils the cold workability and the machinability of steel, the upper limit is to be 1.50%. Preferably, Ni is contained in the range of 1.20% or lower.

With respect to the induction quenching steel of the invention, for enhancing the fatigue strength of steel, in response to sorts of non-metallic inclusions, there are provided limitations on a maximum size of non-metallic inclusions and a distributed density of non-metallic inclusions having sizes larger than predetermined size. Non-metallic inclusions are tested in accordance with JIS G 0555 (microscopic testing method of non-metallic inclusions of steel), and sorts are divided of non-metallic inclusions observed on faces to be tested, while equivalent circular diameters and the number thereof are measured. The "equivalent circular diameter" herein is defined by a diameter of a circle having an equal area to the area of the non-metallic inclusion observed on the face to be tested.

The induction quenching steel of the invention is formed into a shape of the machinery structural part, and then subjected to a hardening heat treatment as the induction quenching to provide a high strength available for usage.

According to results of many tests, in order to realize the high strength steel having the high fatigue strength with less distribution of the fatigue strength, it is necessary that maximum sizes of contained non-metallic inclusions are, in terms of equivalent circular diameters, 15 $\mu$m or less in oxide based non-metallic inclusions, 5 $\mu$m or less in nitride based non-metallic inclusions, and 15 $\mu$m or less in sulfide based non-metallic inclusions respectively, and the numbers of the non-metallic inclusions of the equivalent circular diameters being 1 $\mu$m or more are 6 or less per 1 $mm^2$ in the oxide based inclusions, 10 or less per 1 $mm^2$ in the nitride based non-metallic inclusions, and 5 or less per 1 $mm^2$ in the sulfide based non-metallic inclusions.

If using the steel containing the above mentioned chemical composition and having properties of the non-metallic inclusions, it is possible to efficiently carry out the process high in dimensional precision by the cold workings such as the cold forging or cold extrusion, and to obtain the machinery structural parts high in the rolling fatigue strength and the torsion fatigue strength by dealing with the hardening heat treatment such as the induction quenching.

EXAMPLES

Steels shown in Table 1 were melted in an arc furnace of 70 ton, vacuum-degassified (degree of vacuum: 1 torr or less and the holding time: 15 minutes or longer), and continuously cast into brooms of 370 mm×500 mm in cross sectional dimension. Al and Ti were added after 3 minutes passed after the vacuum degassfication treatment. The broom materials were hot-rolled into bar steels of 80 mm diameter and 55 mm diameter, and normalized 900° C.×60 min in an air. Some of the bar steels were subjected to the heating of 750° C.×8 hr, followed by spheroidizing annealings of 10° C./1 hr.

TABLE 1-a

| | Chemical composition (mass %) | | | | | | | | | | | | Remarks Note) nd: Not detected |
|---|---|---|---|---|---|---|---|---|---|---|---|---|---|
| | C | Si | Mn | S | Al | Ti | B | N | O | Ni | Cr | Mo | |
| Example 1 | 0.46 | 0.08 | 0.28 | 0.010 | 0.021 | 0.035 | 0.0014 | 0.008 | 0.0008 | 0.08 | 0.15 | nd | |
| Example 2 | 0.48 | 0.06 | 0.35 | 0.009 | 0.022 | 0.038 | 0.0012 | 0.007 | 0.0009 | 0.07 | 0.16 | nd | |
| Example 3 | 0.47 | 0.07 | 0.42 | 0.005 | 0.028 | 0.038 | 0.0015 | 0.009 | 0.0008 | 0.08 | 0.15 | nd | |
| Example 4 | 0.46 | 0.09 | 0.22 | 0.010 | 0.025 | 0.036 | 0.0011 | 0.009 | 0.0010 | 0.05 | 0.43 | nd | |
| Example 5 | 0.47 | 0.09 | 0.31 | 0.009 | 0.028 | 0.036 | 0.0011 | 0.008 | 0.0009 | 0.06 | 0.14 | 0.28 | |
| Example 6 | 0.48 | 0.07 | 0.23 | 0.010 | 0.031 | 0.030 | 0.0014 | 0.007 | 0.0009 | 1.05 | 0.17 | nd | |
| Example 7 | 0.52 | 0.09 | 0.28 | 0.006 | 0.033 | 0.038 | 0.0013 | 0.009 | 0.0008 | 0.07 | 0.18 | nd | |
| Example 8 | 0.53 | 0.08 | 0.31 | 0.010 | 0.029 | 0.039 | 0.0015 | 0.008 | 0.0010 | 0.04 | 0.21 | nd | |
| Example 9 | 0.54 | 0.09 | 0.41 | 0.010 | 0.031 | 0.035 | 0.0015 | 0.009 | 0.0010 | 0.08 | 0.18 | nd | |
| Example 10 | 0.52 | 0.07 | 0.21 | 0.007 | 0.029 | 0.032 | 0.0012 | 0.007 | 0.0007 | 0.09 | 0.42 | nd | |
| Example 11 | 0.52 | 0.07 | 0.24 | 0.011 | 0.028 | 0.032 | 0.0012 | 0.007 | 0.0009 | 0.05 | 0.13 | 0.20 | |
| Example 12 | 0.53 | 0.08 | 0.26 | 0.010 | 0.026 | 0.034 | 0.0015 | 0.008 | 0.0010 | 1.18 | 0.18 | nd | |
| Example 13 | 0.57 | 0.08 | 0.24 | 0.009 | 0.027 | 0.034 | 0.0012 | 0.006 | 0.0009 | 0.07 | 0.13 | nd | |
| Example 14 | 0.56 | 0.07 | 0.30 | 0.009 | 0.028 | 0.025 | 0.0011 | 0.007 | 0.0009 | 0.07 | 0.17 | nd | |
| Example 15 | 0.57 | 0.09 | 0.41 | 0.010 | 0.029 | 0.036 | 0.0014 | 0.008 | 0.0010 | 0.08 | 0.15 | nd | |

TABLE 1-b

| | Chemical composition (mass %) | | | | | | | | | | | | |
|---|---|---|---|---|---|---|---|---|---|---|---|---|---|
| | C | Si | Mn | S | Al | Ti | B | N | O | Ni | Cr | Mo | Remarks |
| Comparative example 1 | 0.41 | 0.07 | 0.28 | 0.011 | 0.030 | 0.031 | 0.0014 | 0.008 | 0.0009 | 0.06 | 0.15 | nd | |
| Comparative example 2 | 0.53 | 0.51 | 0.45 | 0.009 | 0.031 | 0.038 | 0.0012 | 0.008 | 0.0009 | 0.09 | 0.16 | nd | |
| Comparative example 3 | 0.54 | 0.07 | 0.72 | 0.008 | 0.028 | 0.033 | 0.0013 | 0.007 | 0.0010 | 0.05 | 0.15 | nd | |
| Comparative example 4 | 0.49 | 0.10 | 0.23 | 0.010 | 0.029 | 0.034 | nd | 0.008 | 0.0008 | 0.06 | 0.15 | nd | |
| Comparative example 5 | 0.53 | 0.08 | 0.25 | 0.009 | 0.031 | 0.035 | nd | 0.009 | 0.0007 | 0.04 | 0.02 | nd | |
| Comparative example 6 | 0.49 | 0.10 | 0.54 | 0.010 | 0.032 | 0.034 | 0.0014 | 0.008 | 0.0021 | 0.03 | 0.16 | nd | |
| Comparative example 7 | 0.53 | 0.09 | 0.27 | 0.009 | 0.031 | 0.096 | 0.0012 | 0.013 | 0.0009 | 0.06 | 0.13 | nd | |
| Comparative example 8 | 0.54 | 0.07 | 0.26 | 0.007 | 0.028 | 0.035 | 0.0015 | 0.014 | 0.0020 | 0.08 | 0.14 | nd | |
| Comparative example 9 | 0.54 | 0.08 | 0.27 | 0.008 | 0.027 | 0.051 | 0.0015 | 0.006 | 0.0010 | 0.09 | 0.16 | nd | |
| Comparative example 10 | 0.51 | 0.08 | 0.28 | 0.018 | 0.030 | 0.036 | 0.0014 | 0.008 | 0.0008 | 0.05 | 0.17 | nd | |
| Comparative example 11 | 0.54 | 0.07 | 0.26 | 0.006 | 0.029 | 0.033 | 0.0016 | 0.007 | 0.0009 | 0.07 | 0.15 | nd | |
| Comparative example 12 | 0.54 | 0.09 | 0.27 | 0.009 | 0.031 | 0.039 | 0.0015 | 0.007 | 0.0010 | 0.06 | 0.14 | nd | |
| Comparative example 13 | 0.53 | 0.07 | 0.25 | 0.008 | 0.012 | 0.032 | 0.0015 | 0.009 | 0.0009 | 0.04 | 0.14 | nd | |
| Comparative example 14 | 0.64 | 0.07 | 0.22 | 0.009 | 0.031 | 0.035 | 0.0014 | 0.006 | 0.0010 | 0.06 | 0.13 | nd | |
| Comparative example 15 | 0.48 | 0.24 | 0.75 | 0.015 | 0.027 | nd | nd | 0.013 | 0.0015 | 0.05 | 0.12 | nd | JIS S48C-Equivalent steel |
| Comparative example 16 | 0.53 | 0.25 | 0.76 | 0.015 | 0.026 | nd | nd | 0.012 | 0.0016 | 0.06 | 0.13 | nd | JIS S53C-Equivalent steel |

The following measuring and testing were made to the above mentioned normalized materials or the annealed materials.

Non-metallic Inclusions

As to the normalized materials of 55 mm diameter, non-metallic inclusions were detected in accordance with JIS G 0555 (microscopic testing method of non-metallic inclusions of steel). The observations were made on the actually visual fields of 2 $mm^2$. As to the oxide based non-metallic inclusions, the nitride based non-metallic inclusions and the sulfide based non-metallic inclusions, the number of non-metallic inclusions larger than the equivalent circular diameter of 1 $\mu$m were measured so as to calculate the number of non-metallic inclusion per 1 $mm^2$. Of the observed non-metallic inclusions, values of those of the maximum equivalent circular diameter are shown as maximum dimension in Table 2.

TABLE 2-a

| | Oxide based inclusions | | Nitride based inclusions | | Sulfide based inclusions | |
|---|---|---|---|---|---|---|
| | Number (Number/mm$^2$) | Maximum size ($\mu$m) | Number (Number/mm$^2$) | Maximum size ($\mu$m) | Number (Number/mm$^2$) | Maximum size ($\mu$m) |
| Example 1 | 1.8 | 6.0 | 9.1 | 2.3 | 3.8 | 11.2 |
| Example 2 | 1.5 | 7.2 | 8.5 | 2.8 | 4.8 | 12.3 |
| Example 3 | 1.6 | 7.5 | 7.9 | 3.1 | 4.9 | 13.4 |
| Example 4 | 1.7 | 6.1 | 6.9 | 2.5 | 4.5 | 14.3 |
| Example 5 | 1.8 | 8.1 | 8.1 | 3.1 | 3.9 | 14.0 |
| Example 6 | 1.4 | 5.6 | 9.5 | 2.2 | 3.5 | 12.9 |
| Example 7 | 1.6 | 10.1 | 8.3 | 3.8 | 4.9 | 14.2 |
| Example 8 | 4.8 | 9.8 | 7.2 | 3.7 | 4.5 | 12.9 |
| Example 9 | 3.2 | 12.1 | 8.9 | 2.9 | 4.2 | 13.9 |
| Example 10 | 4.3 | 11.1 | 8.4 | 4.1 | 3.9 | 13.2 |
| Example 11 | 3.5 | 13.4 | 9.6 | 2.5 | 4.8 | 12.1 |
| Example 12 | 4.8 | 8.2 | 7.2 | 3.4 | 3.9 | 11.0 |
| Example 13 | 3.5 | 12.4 | 8.5 | 3.7 | 4.6 | 14.2 |
| Example 14 | 4.8 | 13.2 | 7.9 | 4.1 | 4.8 | 14.9 |
| Example 15 | 4.7 | 10.9 | 7.4 | 2.8 | 4.3 | 12.6 |

TABLE 2-b

| | Oxide based inclusions | | Nitride based inclusions | | Sulfide based inclusions | |
|---|---|---|---|---|---|---|
| | Number (Number/mm$^2$) | Maximum size ($\mu$m) | Number (Number/mm$^2$) | Maximum size ($\mu$m) | Number (Number/mm$^2$) | Maximum Size ($\mu$m) |
| Comparative example 1 | 4.2 | 12.1 | 6.9 | 2.9 | 4.4 | 13.1 |
| Comparative example 2 | 4.1 | 13.5 | 8.5 | 3.1 | 4.0 | 14.0 |
| Comparative example 3 | 3.9 | 14.2 | 9.3 | 3.2 | 3.8 | 13.2 |
| Comparative example 4 | 2.6 | 13.0 | 9.1 | 2.7 | 4.6 | 14.8 |
| Comparative example 5 | 4.2 | 12.3 | 7.9 | 2.7 | 4.3 | 13.5 |
| Comparative example 6 | 3.4 | 18.2 | 8.2 | 2.7 | 4.5 | 12.3 |
| Comparative example 7 | 3.1 | 11.1 | 8.9 | 7.5 | 3.2 | 14.6 |
| Comparative example 8 | 3.1 | 19.1 | 8.7 | 8.3 | 3.8 | 13.2 |
| Comparative example 9 | 3.5 | 11.2 | 7.9 | 3.4 | 4.5 | 14.2 |
| Comparative example 10 | 3.2 | 12.3 | 9.1 | 4.6 | 3.2 | 18.2 |
| Comparative example 11 | 2.3 | 19.4 | 8.2 | 3.1 | 3.2 | 14.1 |
| Comparative example 12 | 3.9 | 10.1 | 4.1 | 9.3 | 4.3 | 13.7 |
| Comparative example 13 | 4.3 | 12.1 | 4.0 | 9.2 | 4.0 | 12.3 |
| Comparative example 14 | 4.9 | 8.1 | 9.2 | 3.8 | 4.5 | 13.4 |
| Comparative example 15 | 4.7 | 18.2 | nd | nd | 4.5 | 14.3 |
| Comparative example 16 | 4.2 | 19.3 | nd | nd | 4.8 | 13.2 |

Depth of the Hardened Layer

Test pieces of 25 mm diameter×80 mm length were cut out from the annealed materials of 55 mm diameter. The induction quenching was performed at the frequency of 10 kHz and for the heating time of 4 seconds in the stationary type, and the depth where the hardness of 450 HV or higher was available was measured. Measured values were made depths of the hardened layers and are shown in Table 3 as parameters of the hardenability.

Deformation Resistance

Test pieces of 6 mm diameter×12 mm length were cut out around a center axis of D/4 position of the annealed materials of 55 mm diameter, and the compression tests were carried out. Stresses when true strain was 0.8 in the compression test are shown as deformation resistance in Table 3.

Cold Workability

Test pieces of 30 mm diameter×200 mm length were cut out from the normalized materials of 55 mm diameter. The cold extrusion was performed at the degression of 40% to demand the extrusion number until the abrasion amount of the tool became 0.2 mm. Table 3 shows that the life ratio of the cold worked tool was defined by the value of the ratio when the value obtained in the comparative example 16 (corresponding to JIS S53C) was 1.

Machinability

Test pieces of 80 mm diameter×300 mm length were cut out from the normalized materials of 80 mm diameter, and the machining tests were performed with the NC lathe under the following machining conditions. The tool life was defined by the machining process time until the average amount of the side flank abrasion width of the tool became 200 $\mu$m. Table 3 shows that the life ratio of the machined tool was defined by the value of the ratio when the value got in the comparative example 16 was 1.

Tool: Cemented carbide P10

Machining rate: 300 m/min

Feed: 0.2 mm/rev

Cutting: 2.0 mm

Cutting oil: Non

Rolling Fatigue Strength

Test pieces of 10 mm diameter×20 mm length were cut out around the center axis of D/4 position of the normalized materials of 55 mm diameter, the induction quenching was performed at the frequency of 100 kHz and for the heating time of 3 seconds in the stationary type, then tempered 180° C.×60 min in the air, and subjected to the rolling fatigue tests.

The rolling fatigue tests were performed by the cylindrical rolling fatigue testing machine with the standard ball of SUJ2 made ¾ inch steel ball and at the contact pressure of 5880 MPa. The rotation number was measured until injuries as pitting appeared on the face of the test piece, and made the life of the rolling fatigue, and the Weibull distribution curves were made from the lives of the rolling fatigue of 20 pieces of test pieces so as to demand the 10% breakage probability lives (L10). Table 3 shows that the value of the ratio when the 10% breakage probability life (L10) of the comparative material 16 was 1, was made the L10 life ratio. The gradients of the Weibull distribution curve were demanded, and the demanded values are shown as the parameter of dispersion in Table 3.

Torsion Fatigue Strength

Round bars of 20 mm diameter×200 mm length were cut out from the normalized materials of 55 mm diameter, formed at 20 mm portions of both ends respectively with the splines of 20 mm pitch circle diameter and 1.0 module, subjected to the induction quenching at the frequency of 10 kHz so that the ratio of the hardened layer was 0.5, and was tempered 180° C.×60 min in the air to produce the torsion fatigue testing pieces.

The test pieces were fitted on the spline portions with holders, effected with torque, and performed with the torsion fatigue test so as to demand the strength for period of time of $2\times10^5$ times. The results are shown as the torsion fatigue strength in Table 3.

TABLE 3-a

| | Depth of | | Ratios of lives of | | Rolling fatigue strength | | |
|---|---|---|---|---|---|---|---|
| | hardened layer (mm) | Deformation resistance (MPa) | cold-worked tools | Ratios of lives of machined tools | L10 lives | Parameters of dispersions | Torsion fatigue strength (MPa) |
| Example 1 | 5.3 | 760 | 3.12 | 2.82 | 2.1 | 4.2 | 835 |
| Example 2 | 5.3 | 784 | 2.76 | 2.51 | 3.2 | 4.6 | 845 |
| Example 3 | 6.0 | 789 | 2.68 | 2.44 | 2.8 | 5.1 | 831 |
| Example 4 | 5.7 | 795 | 2.39 | 2.20 | 3.2 | 4.8 | 843 |
| Example 5 | 6.6 | 791 | 1.61 | 1.53 | 4.5 | 4.3 | 850 |
| Example 6 | 5.3 | 774 | 2.55 | 2.33 | 4.8 | 4.9 | 855 |
| Example 7 | 5.6 | 806 | 2.47 | 2.26 | 5.2 | 5.2 | 860 |
| Example 8 | 6.2 | 821 | 2.22 | 2.05 | 5.6 | 4.5 | 871 |
| Example 9 | 6.5 | 843 | 1.94 | 1.81 | 4.8 | 4.3 | 882 |
| Example 10 | 6.0 | 824 | 1.94 | 1.81 | 6.2 | 5.2 | 851 |
| Example 11 | 6.2 | 802 | 1.80 | 1.69 | 8.2 | 4.8 | 891 |
| Example 12 | 5.9 | 818 | 1.88 | 1.75 | 9.4 | 4.7 | 887 |
| Example 13 | 5.3 | 823 | 2.30 | 2.11 | 6.1 | 4.9 | 871 |
| Example 14 | 5.4 | 832 | 2.12 | 1.96 | 4.9 | 5.0 | 873 |
| Example 15 | 6.4 | 858 | 1.77 | 1.66 | 5.1 | 4.3 | 876 |

TABLE 3-b

| | Depth of hardened layer (mm) | Deformation resistance (MPa) | Ratios of lives of cold-worked tools | Ratios of lives of machined tools | Rolling fatigue strength L10 lives | Rolling fatigue strength Parameters of dispersions | Torsion fatigue strength (MPa) |
|---|---|---|---|---|---|---|---|
| Comparative example 1 | 5.1 | 724 | 3.59 | 3.22 | 0.1 | 4.5 | 791 |
| Comparative example 2 | 7.1 | 913 | 1.31 | 1.27 | 2.1 | 4.7 | 851 |
| Comparative example 3 | 7.2 | 889 | 1.25 | 1.21 | 3.1 | 4.5 | 871 |
| Comparative example 4 | 3.5 | 774 | 2.95 | 2.68 | 0.7 | 4.6 | 792 |
| Comparative example 5 | 3.3 | 780 | 2.99 | 2.71 | 0.8 | 4.4 | 772 |
| Comparative example 6 | 6.5 | 831 | 2.10 | 1.94 | 0.9 | 2.6 | 821 |
| Comparative example 7 | 5.2 | 804 | 2.56 | 2.34 | 0.7 | 2.4 | 805 |
| Comparative example 8 | 5.7 | 807 | 2.50 | 2.29 | 0.8 | 2.5 | 810 |
| Comparative example 9 | 5.8 | 843 | 1.98 | 1.85 | 1.3 | 2.8 | 814 |
| Comparative example 10 | 5.6 | 800 | 2.50 | 2.30 | 1.0 | 2.7 | 802 |
| Comparative example 11 | 5.7 | 807 | 2.35 | 2.29 | 1.1 | 2.5 | 810 |
| Comparative example 12 | 5.6 | 798 | 2.20 | 2.12 | 0.9 | 2.6 | 799 |
| Comparative example 13 | 5.7 | 802 | 2.12 | 2.10 | 2.3 | 4.2 | 785 |
| Comparative example 14 | 5.9 | 865 | 1.73 | 1.63 | 6.1 | 4.0 | 781 |
| Comparative example 15 | 4.9 | 879 | 1.53 | 1.45 | 0.5 | 3.2 | 782 |
| Comparative example 16 | 5.2 | 918 | 1.00 | 1.00 | 1.0 | 3.4 | 802 |

According to the above tested results, in comparison with JIS S48C (Comparative example 15) and S53C (Comparative example 16) generally used for the induction quenching, the Comparative example 1 of lower C than the inventive range is superior in the cold workability but inferior in the rolling fatigue strength and the torsion fatigue strength. The Comparative examples 2 and 3 of high Si and Mn are inferior in the cold workability. The Comparative examples 4 and 5 not containing B are inferior in the induction quenching and low in the rolling fatigue strength and the torsion fatigue strength.

The Comparative examples 6, 7 and 8 where the contents of O and N are high and large sized oxide based non-metallic inclusions and nitride based non-metallic inclusions are recognized, are lower in the rolling fatigue strength and the torsion fatigue strength and large in dispersion of the rolling fatigue strength. In the Comparative example 9 of high Ti, TiC is recognized in the metallic structure and the cold workability is inferior. The Comparative examples 10, 11 and 12 containing large sized non-metallic inclusions are low in the rolling fatigue strength and the torsion fatigue strength.

In the Comparative example 13 of low Al, the crystal grain is coarsened and the torsion fatigue strength is poor. The Comparative example 14 of high C is inferior in the cold workability and the torsion fatigue strength.

In contrast, it is seen that the Examples 1 to 15 of the invention have the excellent induction hardenability, cold workability, machinability, rolling fatigue strength and torsion fatigue strength. If using the inventive steels for the induction quenching, it is possible to provide the machinery structural parts having the superior rolling fatigue strength and torsion fatigue strength.

According to the invention, it is possible to offer steels suited to the induction quenching, having an excellent cold workability, high rolling fatigue strength and torsion fatigue strength with less dispersions of the fatigue strength as well as machinery structural parts.

What is claimed is:

1. A steel for induction quenching comprising: ,by mass %,

C: 0.45 to 0.60%,

Si: 0.01 to 0.15%,

Mn: 0.20 to 0.60%,

S: 0.012% or lower,

Al: 0.015 to 0.040%,

Ti: 0.005 to 0.050%,

B: 0.0005 to 0.0050%,

N: 0.010% or lower,

O: 0.0010% or lower, and balance being Fe and unavoidable impurities, wherein maximum sizes of contained non-metallic inclusions are, in terms of equivalent circular diameters, 15 $\mu$m or less in oxide based non-metallic inclusions, 5 $\mu$m or less in nitride based non-metallic inclusions, and 15 $\mu$m or less in sulfide based non-metallic inclusions respectively, and the numbers of the non-metallic inclusions of the equivalent circular diameters being 1 $\mu$m or more are 6 or less per 1 $mm^2$ in the oxide based inclusions, 10 or less per 1 $mm^2$ in the nitride based non-metallic inclusions, and 5 or less per 1 $mm^2$ in the sulfide based non-metallic inclusions.

2. The steel for induction quenching according to claim 1, further comprising, in addition to the above chemical composition, at least one of:

Cr: 1.00% or lower,

Mo: 0.50% or lower, and

Ni: 1.50% or lower.

3. Machinery structural parts comprising the steel for induction quenching according to claim 1.

4. Machinery structural parts comprising the steel for induction quenching according to claim 2.

* * * * *